US007926978B2

(12) United States Patent
Tsai

(10) Patent No.: US 7,926,978 B2
(45) Date of Patent: Apr. 19, 2011

(54) LIGHT SET WITH SURFACE MOUNTED LIGHT EMITTING COMPONENTS

(76) Inventor: Kenneth Tsai, Zhonghe (TW)

( * ) Notice: Subject to any disclaimer, the term of this patent is extended or adjusted under 35 U.S.C. 154(b) by 172 days.

(21) Appl. No.: 12/314,862

(22) Filed: Dec. 18, 2008

(65) Prior Publication Data

US 2010/0157598 A1 Jun. 24, 2010

(51) Int. Cl.
*F21S 4/00* (2006.01)
*F21V 21/00* (2006.01)

(52) U.S. Cl. ..... 362/249.02; 362/311.02; 362/654; 362/800

(58) Field of Classification Search ..... 362/249.02, 362/800, 311.02, 652–654
See application file for complete search history.

(56) References Cited

U.S. PATENT DOCUMENTS 5,893,633 A * 4/1999 Uchio et al. ..... 362/244
6,837,598 B2 * 1/2005 Marcus ..... 362/374

* cited by examiner

*Primary Examiner* — Jason Moon Han
(74) *Attorney, Agent, or Firm* — Rosenberg, Klein & Lee

(57) ABSTRACT

A light set with surface mounted light emitting components includes a first conducting wire and a second conducting wire disposed adjacent to the first conducting wire. The first and second conducting wires are correspondingly formed at a predetermined interval with a plurality of first and second contact-pad areas, respectively, at where a first and a second conductor of the first and the second conducting wire, respectively, are exposed. At least one surface mounted light emitting component is straddled on and between the corresponding first and the second contact-pad areas with two leads of the light emitting component electrically connected to the first and the second conductor via a conductive material, so that the surface mounted light emitting component and the first and second conducting wires are in an electrical contact state.

3 Claims, 7 Drawing Sheets

LIGHT SET WITH SURFACE MOUNTED LIGHT EMITTING COMPONENTS

FIELD OF THE INVENTION

The present invention relates to a light set with semiconductor light emitting components, and more particularly, to a light set with surface mounted light emitting components.

BACKGROUND OF THE INVENTION

In recent years, semiconductor light emitting components have gradually replaced the traditional lighting devices. The light emitting diode (LED) has a lot of advantages, such as small volume, quick response time, long service life, not easily attenuated, rigid outer case, vibration-resistant, emitting all kinds of color lights, including invisible light, allowing oriented-design, low voltage, low current, low conversion loss, low thermal radiation, easily mass-producible, environmental friendly, etc.

A conventional LED includes an LED dice encapsulated in a lamp-shaped package. A pair of leads is extended from the LED dice through the package for electrically connecting to external power sources. To use the LED, the pair of leads are separately soldered to a positive conductor and a negative conductor, so that electric current can be supplied to the LED dice via the leads for the LED to emit light. Since the lamp-shaped LED has a relatively large volume, a surface mounted LED having a relatively small volume has been developed in response to the future trend of small-scale packaging and automated production of LEDs.

While the LED has a lot of advantages, it has the disadvantage of insufficient brightness due to its characteristics of low voltage and low current. Generally, to increase the brightness of the LED, a plurality of LEDs are combined or serially connected to form a light set or a light string for use.

As can be seen from the above description, the pair of leads of the conventional semiconductor light emitting component are soldered to conductors. Since it is uneasy to control the soldering quality, the stable connection of the semiconductor light emitting components to the conductors is inevitably affected by a poor lead soldering quality and the semiconductor light emitting components are easily subject to damage and separation under an external force and have relatively low reliability.

Moreover, when a plurality of semiconductor light emitting components is combined or serially connected, the pairs of leads of all the semiconductor light emitting components must be soldered to the conductors one by one. It is very complicated and difficult to do so, and the overall production rate is particularly low when there are a quite large number of semiconductor light emitting components to be soldered.

SUMMARY OF THE INVENTION

It is therefore a primary object of the present invention to provide a light set with surface mounted light emitting components, which can be easily processed and assembled without difficulties in production thereof.

Another object of the present invention is to provide a light set with surface mounted light emitting components, which has stable and firm structure to protect the semiconductor light emitting components thereof against damage or separation, and is therefore very reliable for use.

To fulfill the above objects, the present invention provides a light set with surface mounted light emitting components. The light set includes a first conducting wire and a second conducting wire and at least one surface mounted light emitting component. The first conducting wire comprises a first conductor and a first insulating layer enclosing the first conductor, and the first conducting wire is formed at predetermined intervals with a plurality of first contact-pad areas, at where the first conductor is exposed from the first insulating layer.

The second conducting wire is disposed adjacent to the first conducting wire, which comprises a second conductor and a second insulating layer enclosing the second conductor. The second conducting wire is formed with a plurality of second contact-pad areas corresponding to the first contact-pad areas on the first conducting wire, and the second conductor is exposed from the second insulating layer at the second contact-pad areas.

The surface mounted light emitting component is straddled on and between the corresponding first and the second contact-pad areas with two leads of the light emitting component electrically connected to the first conductor of the first conducting wire and the second conductor of the second conducting wire via a conductive material, so that the surface mounted light emitting component and the first and second conducting wires are in an electrical contact state.

With the technical means adopted by the present invention, it is not necessary to solder leads of the surface mounted light emitting components to the first and second conducting wires of the light set. Instead, every surface mounted light emitting component can be directly straddled on and between each paired first and second contact-pad areas correspondingly formed on the first and the second conducting wire with the leads of the surface mounted light emitting component electrically connected to first and second conductors of the first and second conducting wires via a conductive material. Therefore, the assembling of the surface mounted light emitting components to the first and second conducting wires is easy and convenient without causing difficulties in the production of the light set.

Moreover, the contact-pad areas allow the surface mounted light emitting components to stably locate on the conductors of the first and second conducting wires with relatively large contact areas between them, so that the surface mounted light emitting components are not subject to damage and separation easily even under an external force, making the light set highly reliable for use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
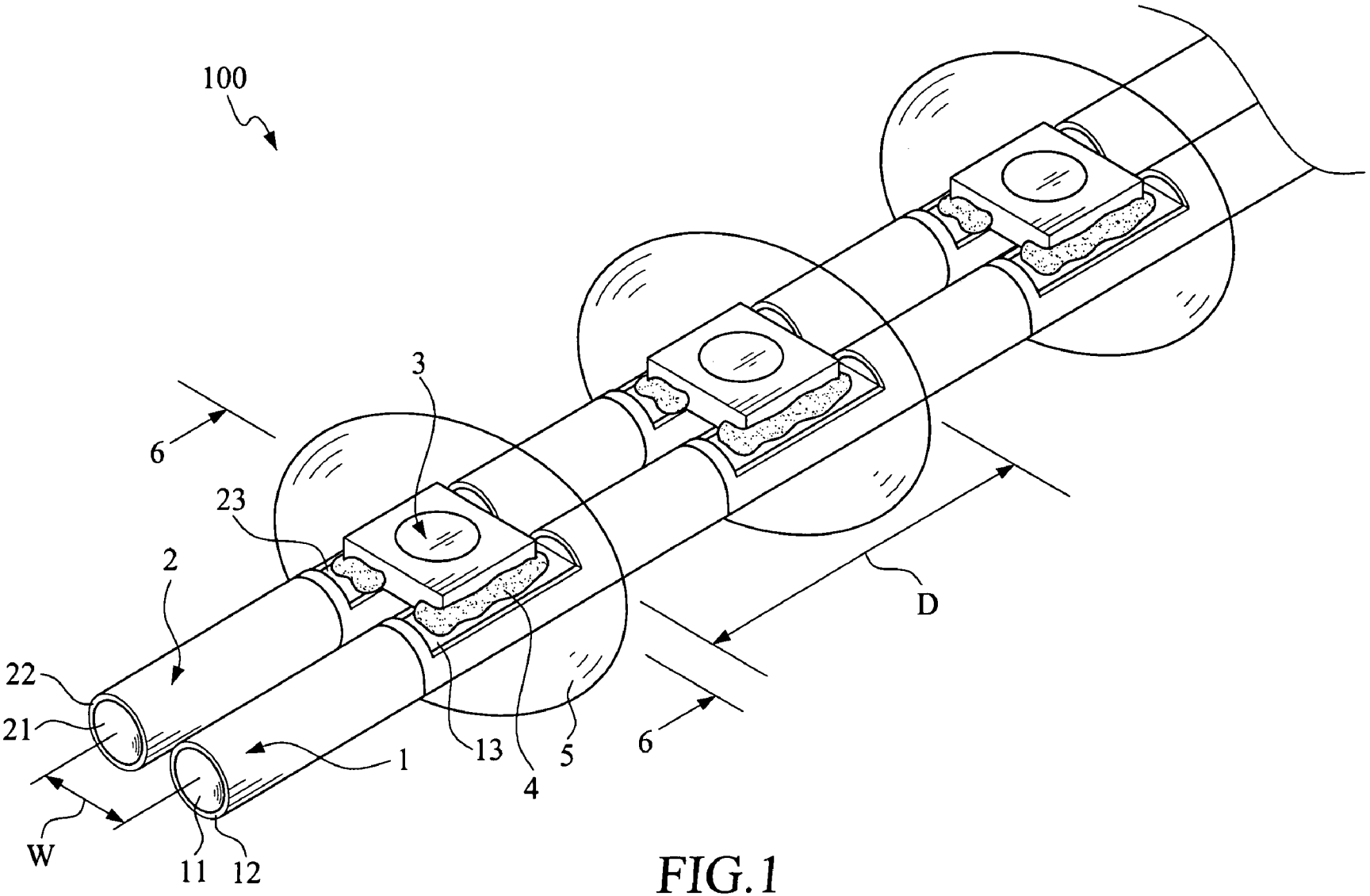
FIG. 1 is a perspective view of a light set with surface mounted light emitting components according to a preferred embodiment of the present invention.

Please refer to FIG. 1 that is a perspective view of a light set with surface mounted light emitting components according to a preferred embodiment of the present invention, which is generally denoted by a reference numeral 100. As shown, the light set 100 includes a first conducting wire 1 and a second conducting wire 2, on which at least one surface mounted light emitting components 3 is provided.

The first conducting wire 1 has a first conductor 11 and a first insulating layer 12 enclosing the first conductor 11. In the illustrated embodiment, the first conducting wire 1 is an enamel-insulated wire with the first conductor 11 being a copper conductor and the first insulating layer 12 being an insulating enamel varnish coating on an outer side of the copper conductor.

The second conducting wire 2 is parallelly disposed adjacent to the first conducting wire 1 to space from the latter by a predetermined width W. The second conducting wire 2 has a second conductor 21 and a second insulating layer 22 enclosing the second conductor 21. Similarly, in the illustrated embodiment, the second conducting wire 2 is an enamel-insulated wire with the second conductor 21 being a copper conductor and the second insulating layer 22 being an insulating enamel varnish coating on an outer side of the copper conductor.

Of course, the first conducting wire 1 and the second conducting wire 2 are not necessarily limited to enamel-insulated wires but can be other types of wires, such as PVC electronic wires, PE wires, cables, etc. Alternatively, the first and the second conducting wire 1, 2 can be together enclosed in an insulating layer as a power cord.

Figure 2:
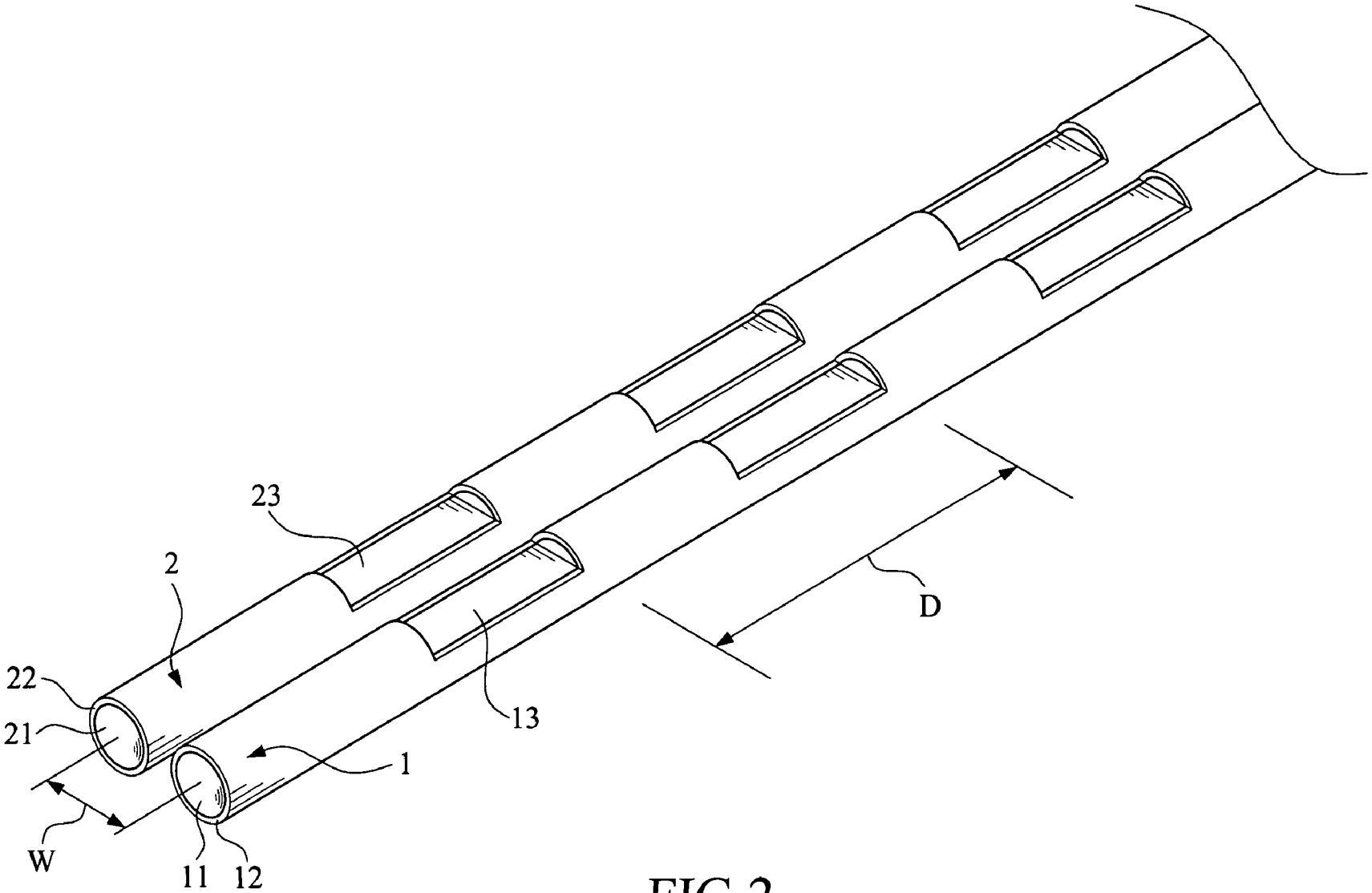
FIG. 2 shows two conducting wires of the light set of FIG. 1, on which contact-pad areas are formed.

Please refer to FIG. 2 that shows the first and the second conducting wire 1, 2 with contact-pad areas 13, 23 formed thereon. As shown, a plurality of first contact-pad areas 13 are formed on the first conducting wire 1 at a predetermined interval D, and the first conductor 11 is exposed at the first contact-pad areas 13. Similarly, a plurality of second contact-pad areas 23 are formed on the second conducting wire 2 at the same interval D to correspond to the first contact-pad areas 13, and the second conductor 21 is exposed at the second contact-pad areas 23.

In practical production of the light set 100, the first conducting wire 1 and the second conducting wire 2 are parallelly disposed. Then, the first and the second conducting wire 1, 2 are simultaneously ground or processed in other manners at the predetermined intervals D to remove a small part of the first insulating layer 12 of the first conducting wire 1 and the second insulating layer 22 of the second conducting wire 2, so as to expose the first conductor 11 and the second conductor 21 thereat. The exposed first and second conductor 11, 21 are further ground to thereby form a plurality of flat-topped first contact-pad areas 13 and second contact-pad areas 23, respectively, enabling the surface mounted light emitting components 3 to be easily straddled on and between the first and the second conducting wire 1, 2 at the correspondingly formed flat-topped first and second contact-pad areas 13, 23.

Figure 3:
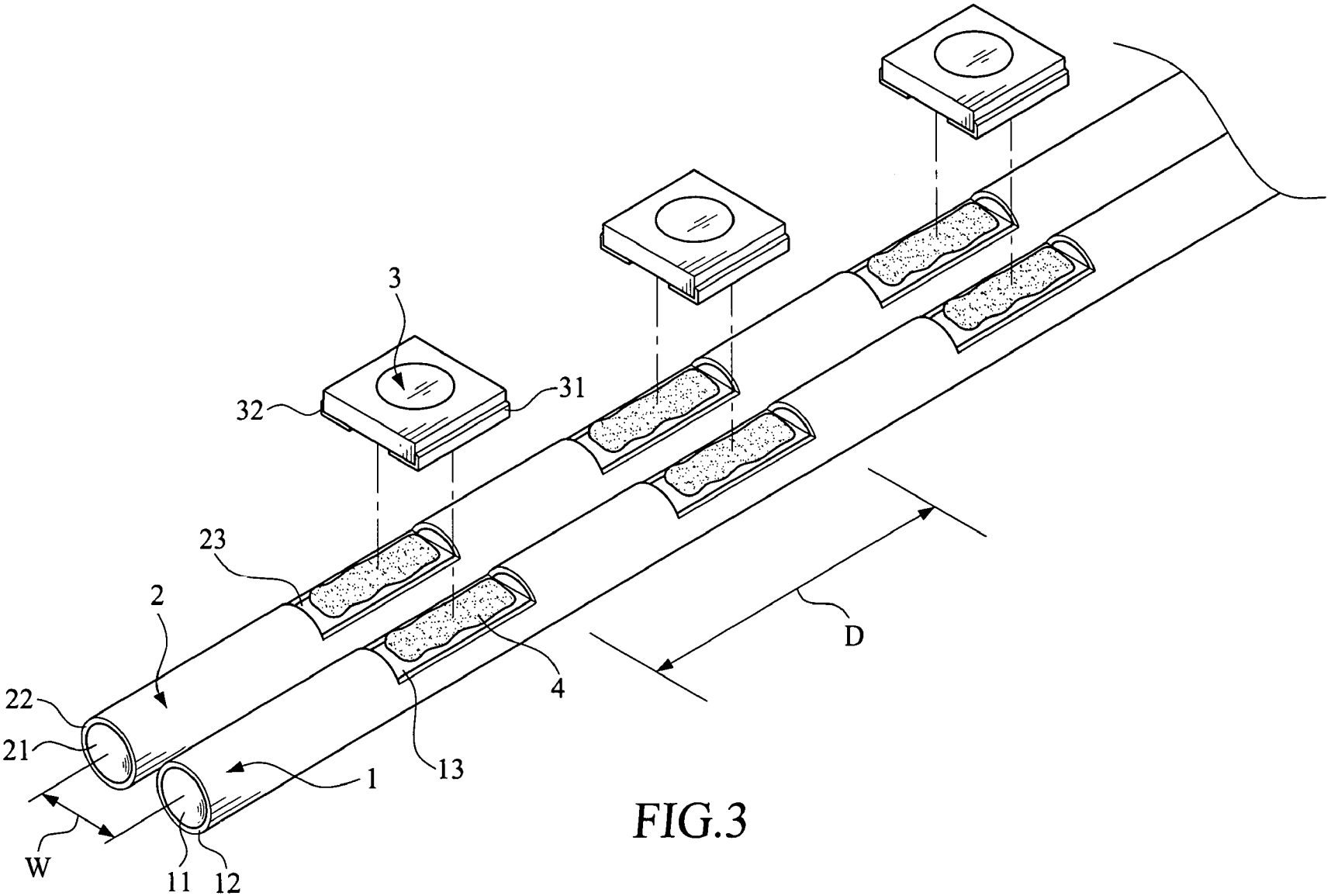
FIG. 3 is an exploded perspective view showing the conducting wires and J-Lead surface mounted light emitting components of the light set of FIG. 1 in a separated state.
Figure 4:
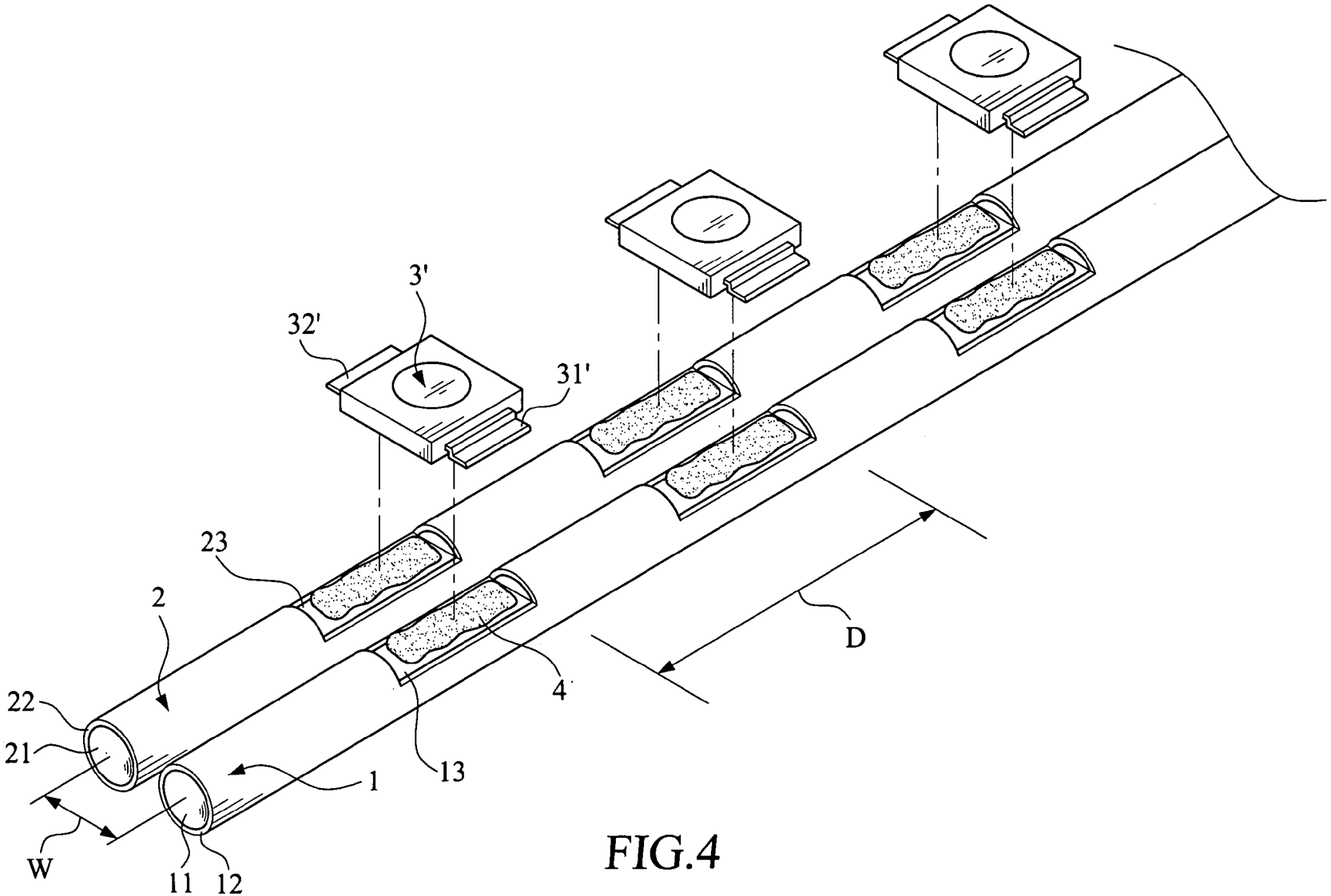
FIG. 4 is another exploded perspective view showing the conducting wires and gull-wing-lead surface mounted light emitting components of the light set of FIG. 1 in a separated state.
Figure 5:
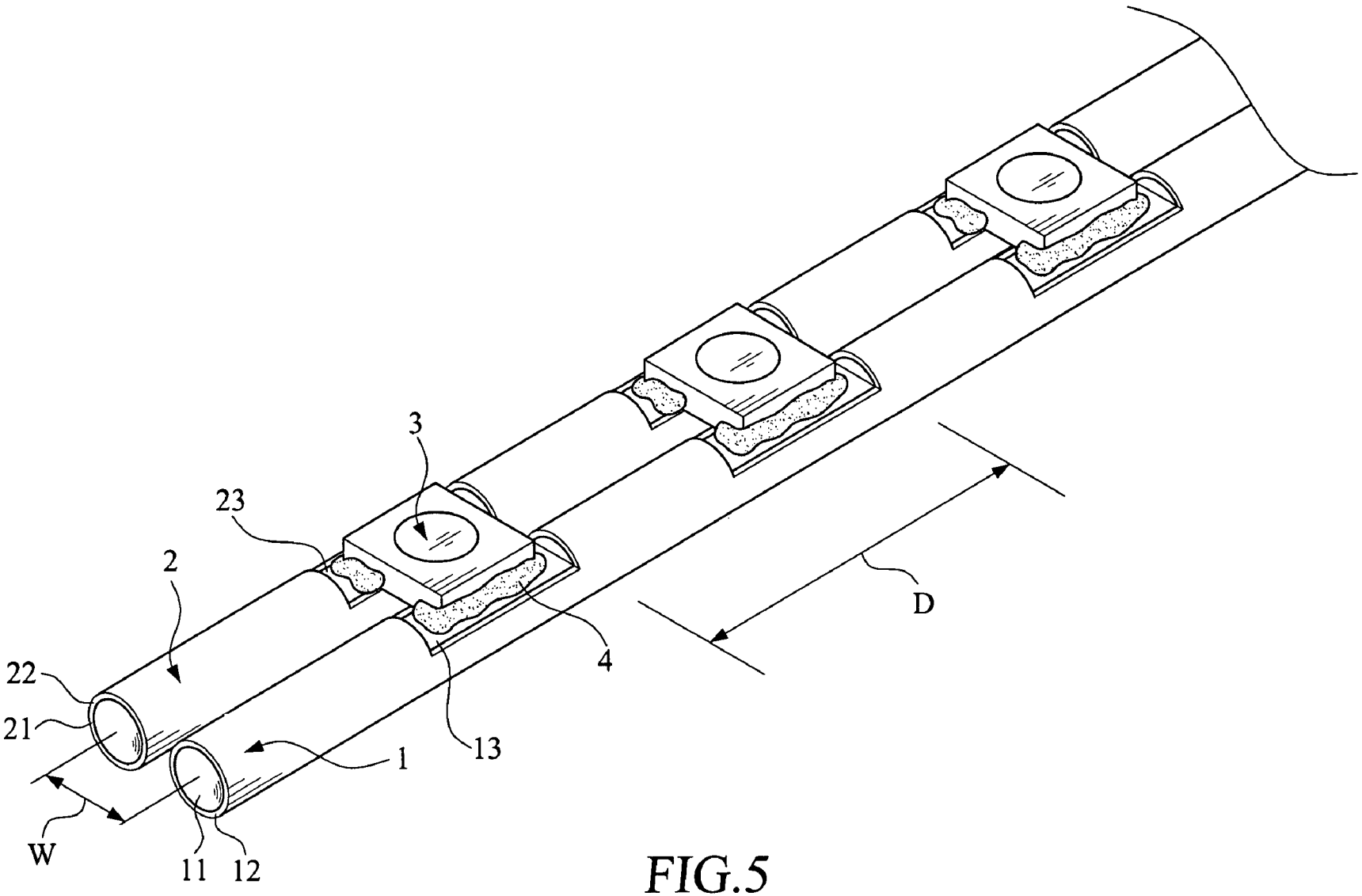
FIG. 5 is an assembled view of FIG. 3.

FIGS. 3 and 4 are two exploded perspective view showing the first and second conducting wires 1, 2 and the surface mounted light emitting components of the light set 100 in a separated state; and FIG. 5 is an assembled perspective view of FIG. 3 showing the first and the second conducting wires 1, 2 and the surface mounted emitting components of the light set 100 in a connected state. In the present invention, various types of surface mount device (SMD) light emitting components can be adopted. For example, the light set shown in FIG. 3 has J-lead surface mounted light emitting components 3, and the light set shown in FIG. 4 has gull-wing-lead surface mounted light emitting components 3'. In the embodiments of the present invention illustrated in FIGS. 3 and 4, the light emitting components 3, 3' are surface mounted light-emitting diodes (LED) and each have a first lead 31, 31' and a second lead 32, 32' for connecting to a positive power source and a negative power source, respectively, so that the surface mounted light emitting components 3, 3' can emit light.

Since the surface mounted light emitting components 3, 3' are connected to the first and the second conducting wire 1, 2 in the same manner, only the surface mounted light emitting components 3 will be referred to in the following description. Before disposing the surface mounted light emitting components 3 on the first and the second conducting wire 1, 2, first apply a layer of conductive material 4 on the first and the second contact-pad areas 13, 23 of the first and the second conducting wire 1, 2, respectively. In the illustrated embodiment, the conductive material 4 is silver paste.

The conductive material 4 will, on the one hand, provide good bonding strength between the surface mounted light emitting components 3 and the first and second conducting wires 1, 2 to ensure stable and fixed straddling of the surface mounted light emitting components 3 on and between the corresponding first and second contact-pad areas 13, 23; and, on the other hand, provide good electric conductivity for the first lead 31 and the second lead 32 of the surface mounted light emitting components 3 to electrically connect to the first conductor 11 of the first conducting wire 1 and the second conductor 21 of the second conducting wire 2, respectively, via the conductive material 4, so that the surface mounted light emitting components 3 and the first and second conducting wires 1, 2 are in an electrically connected state.

In practical production of the light set 100, since the first contact-pad areas 13 on the first conducting wire 1 and the second contact-pad areas 23 on the second conducting wire 2 allow the surface mounted light emitting components 3 to stably locate thereon, it is only needed to apply a layer of the conductive material 4 on each of the first and the second contact-pad areas 13, 23 and straddle the surface mounted light emitting components 3 on and between the first and the second contact-pad areas 13, 23 to obtain a firm overall structure for the light set 100. It is no need to solder the leads 31, 32 one by one to the first conductor 11 and the second conductor 21, respectively. Therefore, the light set 100 can be easily and conveniently assembled without difficulties.

Of course, there are various types of surface mounted light emitting components with different specifications. Some of the surface mounted light emitting components are designed to have three or more leads. In this case, the number of the conducting wires can be adjusted to meet with that of the leads, so that each of the conducting wires can provide an electric signal needed by each of the leads, and each of the conducting wires are provided with contact-pad areas at the predetermined intervals. In this manner, each of the leads of the surface mounted light emitting components located on the contact-pad areas on that conducting wires is electrically connected to one corresponding conducting wire.

Figure 6:
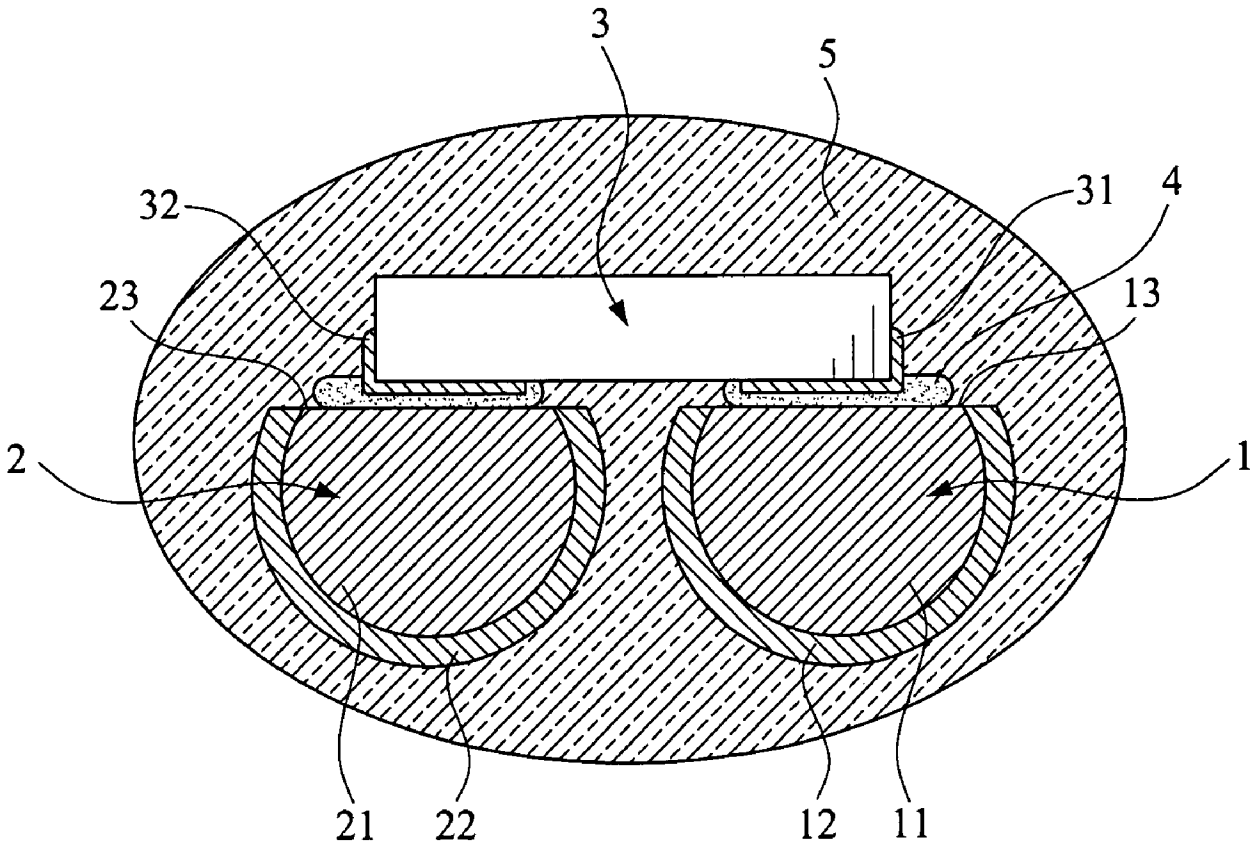
FIG. 6 is an enlarged cross sectional view taken along line 6-6 of FIG. 1.

FIG. 6 is an enlarged cross sectional view taken along line 6-6 of FIG. 1. Please refer to FIGS. 1 and 6 at the same time. In the preferred embodiment of the present invention, after the surface mounted light emitting components 3 have been straddled on and between the first and the second conducting wire 1, 2 at the contact-pad areas 13, 23, a layer of transparent package 5 is further applied to an outer side of every paired first and second contact-pad areas 13, 23 on the first and the second conducting wire 1, 2 and the surface mounted light emitting component 3 bonded thereto, so as to prevent the surface mounted light emitting components 3 and the exposed first and second conductors 11, 21 of the first and second conducting wires 1, 2 from electrically contacting with an external environment and resume the partially ground off first and second insulating layers 12, 22 of the first and second conducting wires 1, 2, respectively, to their original insulating effect. Meanwhile, the transparent package 5 protects the surface mounted light emitting components 3 against failure due to contacting with external dust and particles.

The transparent package 5 further strengthens the connection between the surface mounted light emitting components 3 and the first and second conducting wires 1, 2, protecting the surface mounted light emitting components 3 against damage and separation from the conducting wires 1, 2 due to external impact and giving the whole light set 100 with improved reliability. On the other hand, the angle of divergence of the light emitted from the surface mounted light emitting components 3 can also be adjusted via the transparent package 5 to meet a user's requirement. In this case, it is of course a transparent material should be selected for the transparent package 5, so that light emitted from the surface mounted light emitting components 3 can pass through the transparent package 5.

Figure 7:
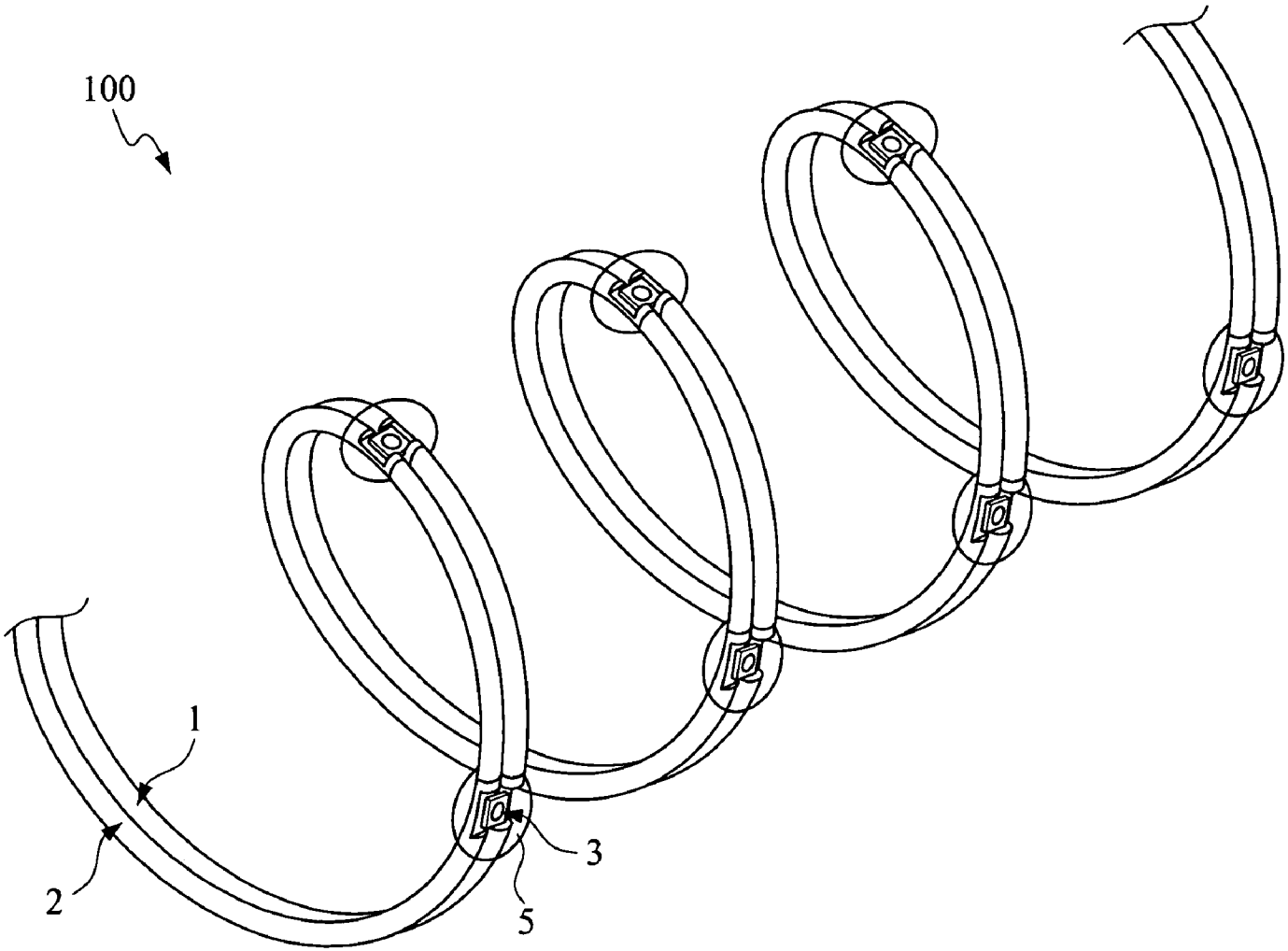
FIG. 7 shows an example of application of the light set with surface mounted light emitting components according to the preferred embodiment of the present invention.

FIG. 7 shows an example of application of the light set 100 of the present invention. As shown, the first and the second conducting wires 1, 2 can be freely bent or coiled to wind around different articles, such as a Christmas tree, a door, a window, etc., to serve as an ornament.

Although the present invention has been described with reference to the preferred embodiments thereof, as well as the best mode for carrying out the present invention, it is apparent to those skilled in the art that a variety of modifications and changes may be made without departing from the scope of the present invention which is intended to be defined by the appended claims.

What is claimed is:

1. A light set, comprising:

a first conducting wire having a first conductor and a first insulating layer enclosing the first conductor, said first insulating layer having a plurality of displaced first openings through said first insulating layer, said first openings defining a respective plurality of first contact-pad areas exposing said first conductor within said plurality of said first contact pad areas;

a second conducting wire being disposed adjacent to the first conducting wire, and having a second conductor and a second insulating layer enclosing the second conductor, said second insulating layer having a plurality of displaced second openings through said second insulating layer aligned with said first openings, said second openings defining a respective plurality of second contact-pad areas exposing said second conductor within said plurality of said second contact pad areas;

at least one surface mounted light emitting component being straddled on and between respective first and second contact-pad areas on the first and the second conducting wire; the surface mounted light emitting component having a first lead and a second lead, which are electrically connected to the first conductor of the first conducting wire and the second conductor of the second conducting wire, respectively, via a conductive paste sandwiched between respective first and second leads and said first and second conducting wires; and a plurality of transparent packages encapsulating every pair of first and second contact-pad areas on the first and second conducting wires and the surface mounted light emitting component bonded thereto;

wherein the first and the second conducting wire are enamel-insulated wires; and the at least one surface mounted light emitting component is a surface mounted light emitting diode.

2. The light set as claimed in claim 1, wherein the conductive paste is silver.

3. The light set as claimed in claim 1, wherein the second conducting wire is disposed parallel adjacent to the first conducting wire.

* * * * *